US005690100A

United States Patent [19]

Pomerantz

[11] Patent Number: 5,690,100

[45] Date of Patent: Nov. 25, 1997

[54] SCUBA DIVING BREATHING REGULATOR

[75] Inventor: Mitchell P. Pomerantz, Highland Park, Ill.

[73] Assignee: Johnson Worldwide Assoc., Inc., Sturtevant, Wis.

[21] Appl. No.: 702,093

[22] Filed: Aug. 23, 1996

[51] Int. Cl.[6] ..... A62B 7/04

[52] U.S. Cl. ..... 128/205.24; 128/204.26

[58] Field of Search ..... 128/204.26, 205.24, 128/201.27, 201.28; 137/375, 908

[56] References Cited

U.S. PATENT DOCUMENTS 4,356,820 11/1982 Trinkwalder ..... 137/908
4,784,129 11/1988 Garraffa .
5,158,106 10/1992 McIntosh ..... 137/375
5,265,596 11/1993 Sauze ..... 128/205.24

*Primary Examiner*—V. Millin
*Assistant Examiner*—William J. Deane, Jr.
*Attorney, Agent, or Firm*—Foley & Lardner

[57] ABSTRACT

A breathing regulator for scuba diving in cold water, the regulator including a high pressure gas inlet and a discharge outlet, a pressure regulator valve assembly having a brass tube operatively connected to said gas inlet, a valve mounted in the tube to control the flow of high pressure gas through the tube, a lever connected to open the valve poppet, a diaphragm operatively positioned to engage the lever to open the valve poppet, and a plastic tube enclosing the brass tube to prevent icing of the tube.

5 Claims, 4 Drawing Sheets

SCUBA DIVING BREATHING REGULATOR

FIELD OF THE INVENTION

The present invention relates generally to scuba diving equipment and more particularly to a breathing regulator which prevents icing of the regulator in cold water.

BACKGROUND OF THE INVENTION

Scuba diving breathing regulators are well known in the art. Typically, they constitute the second of two stages of gas pressure regulation between one or more tanks of compressed gas and the diver's respiratory system. Thus, one of the principal functions of a scuba diver's breathing regulator is to provide gas to the diver at the appropriate pressure to enable the diver to breathe normally under water. For each breathing cycle, high pressure gas flows through the valve orifice and into the breathing chamber. As this gas flows through and around the valve mechanism it rapidly expands into the breathing chamber and a pressure drop occurs. This rapid pressure drop and expanse of gas causes a cooling condition. If scuba diving in cold water, the valve mechanism and housing of the regulator can become supercooled below the freezing point of water. If moisture is present in the regulator housing, either from exhaled breath or the surrounding environment, it will condense and freeze on these supercooled parts causing an icing condition within the regulator housing. Ice can continue to build up to the point where it can block the mechanism from proper operation. The valve mechanism freezes in an open position bringing about continued cooling and freezing and thereby causing a dangerous breathing condition in addition to a rapid depletion of the diver's gas supply. As a result there has been a need for an improved breathing regulator which overcomes the aforementioned disadvantage. More specifically, there is a need to insulate the brass tube in the gas control system to prevent icing of the metallic parts.

SUMMARY OF THE PRESENT INVENTION

The present invention provides an improved breathing regulator having an insulating sleeve mounted on the brass tube which houses the gas control system of the regulator. The insulating sleeve is formed of plastic material which prevents the formation of ice on the brass tube. With this arrangement the diver's safety has been improved by reducing the possibility of icing on the regulator mechanism.

It is therefore a principal object of the present invention to provide an improved breathing regulator having a novel and highly advantageous insulator which substantially reduces or entirely overcomes the possibility of icing on the brass tube.

It is an additional object of the present invention to provide an insulating sleeve which is positively located on the brass tube by providing an oval plug on the sleeve which matingly engages a corresponding oval opening in the brass sleeve.

Other principal features and advantages of the invention will become apparent to those skilled in the art upon review of the following drawings, the detailed description and the appended claims.

Figure 2:
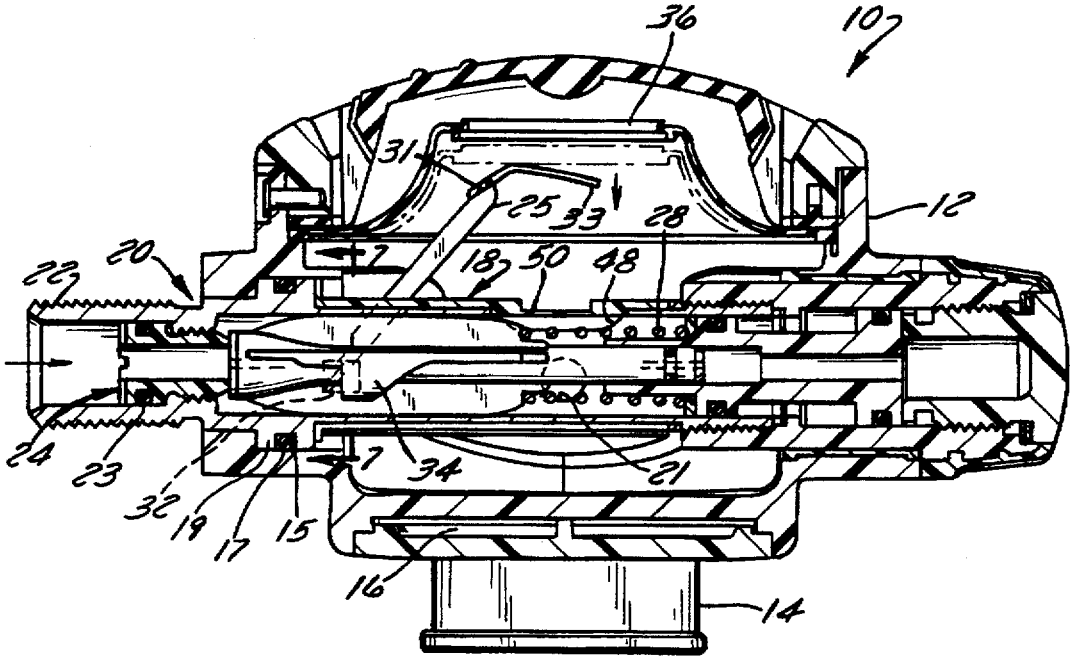
FIG. 2 is a cross section view taken on line 2—2 of FIG. 1 of the regulator with the pressure valve shown in the closed position.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 1:
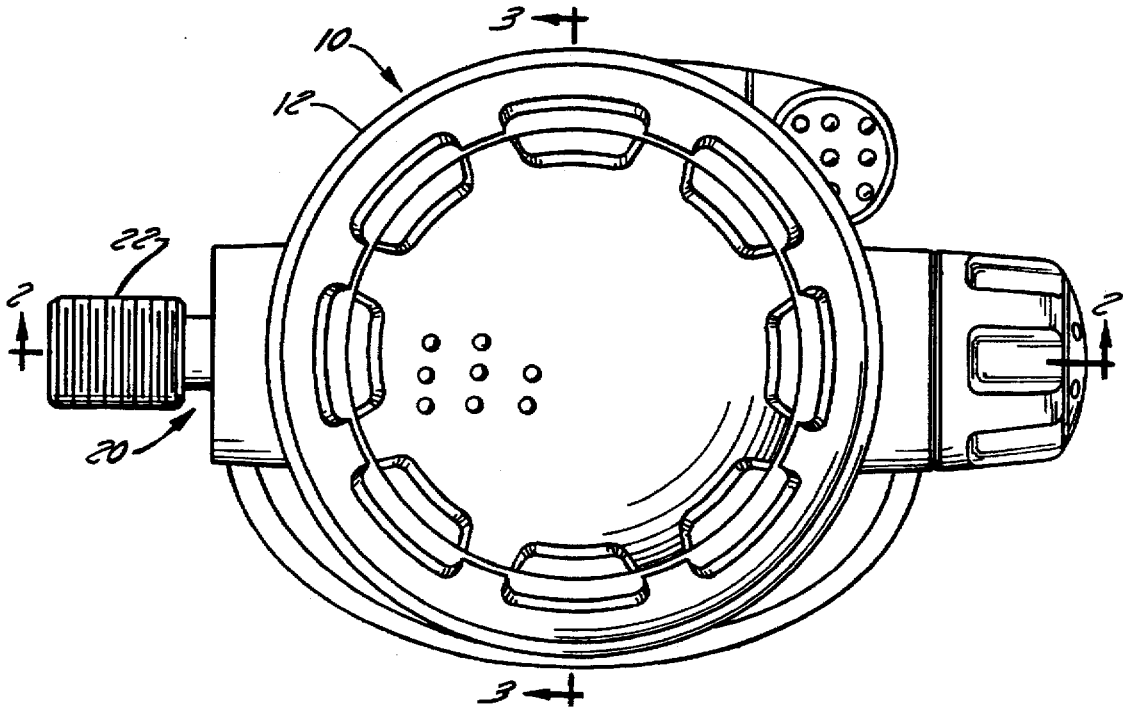
FIG. 1 is a top view of a breathing regulator according to the present invention.
Figure 3:
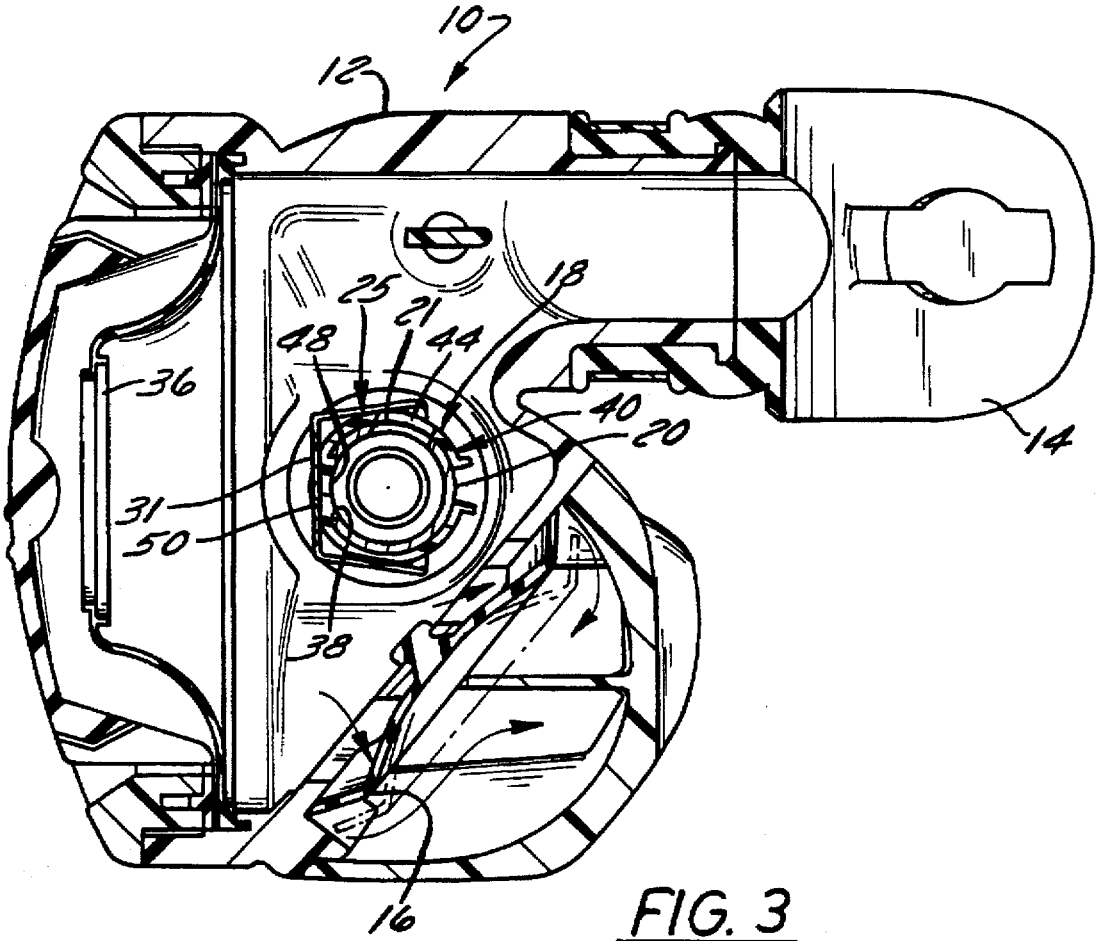
FIG. 3 is a cross section view taken on line 3—3 of FIG. 1 of the regulator.
Figure 4:
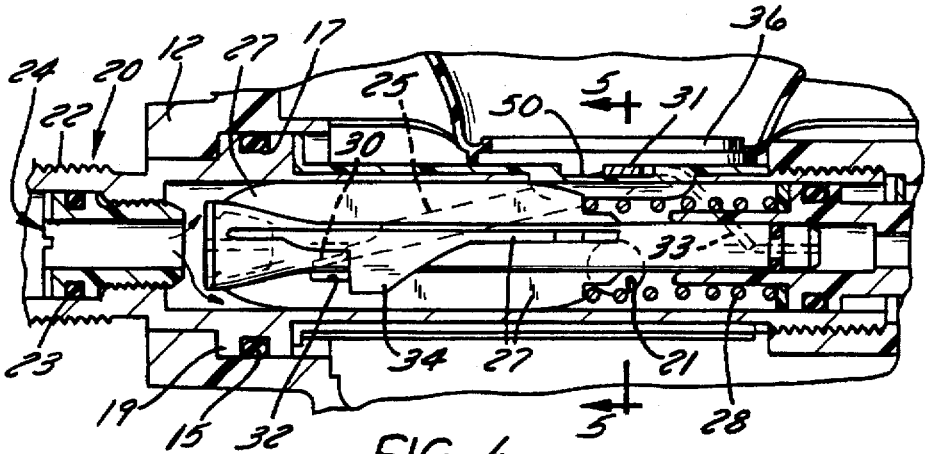
FIG. 4 is a view similar to FIG. 2 showing the pressure valve in the open position.
Figure 7:
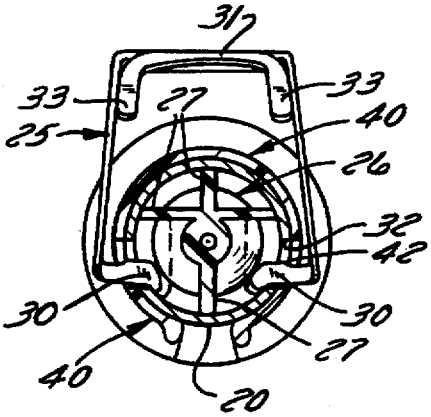
FIG. 7 is a cross section view taken on line 2—2 of FIG. 2 showing lever in the valve closed position.
Figure 5:
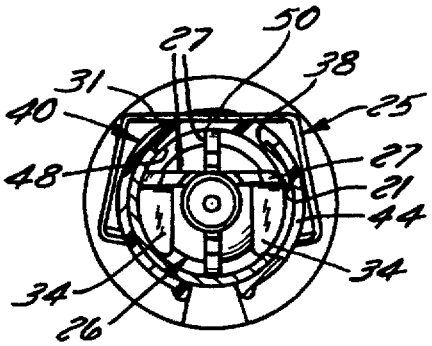
FIG. 5 is a cross section view taken on line 5—5 of FIG. 4 showing the lever in the open position.
Figure 8:
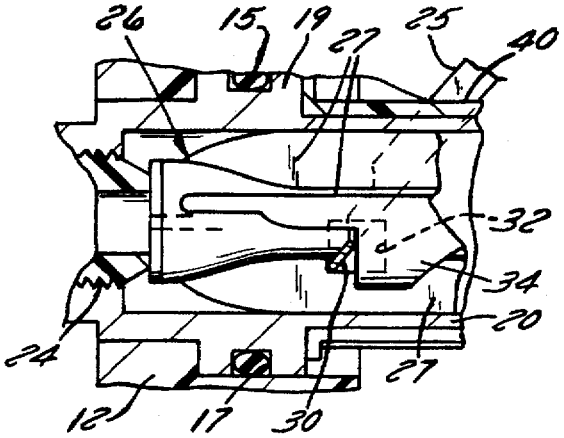
FIG. 8 is an enlarged view similar to FIG. 7 showing the pressure valve in the closed position.

Referring to FIGS. 1, 2 and 3 a typical breathing regulator 10 is shown having a housing 12, a mouthpiece 14 and an exhaust valve 16. A gas control regulator assembly 18 is mounted in the housing 12. The regulator assembly 18 includes a brass tube 20 having a threaded inlet 22 operatively connected to a high pressure gas source (not shown). The brass tube 20 is sealed in the housing by means of an O-ring 15 mounted in a groove 17 formed in flange 19. A high pressure valve orifice 24 is mounted in the inlet 22 of the brass tube 20. An outlet 21 is provided in the side of the brass tube for discharge of high pressure gas into the housing 12. The valve orifice 24 is sealed in the inlet 22 by means of an O-ring 23.

A valve poppet 26 is mounted in the brass tube 20 for movement between open and closed positions with respect to the valve orifice 24. The valve poppet is biased by a spring 28 to a closed position with respect to the valve orifice 24. The valve poppet 26 is opened by means of a lever 25 pivotally mounted on the brass tube 20 by means of a pair of inwardly projecting tabs 30 which are aligned in openings 32 in the brass tube 20 and positioned to operatively engage vanes 34 provided on the valve poppet 26. The valve poppet 26 is aligned in the brass tube by flanges 27.

Figure 6:
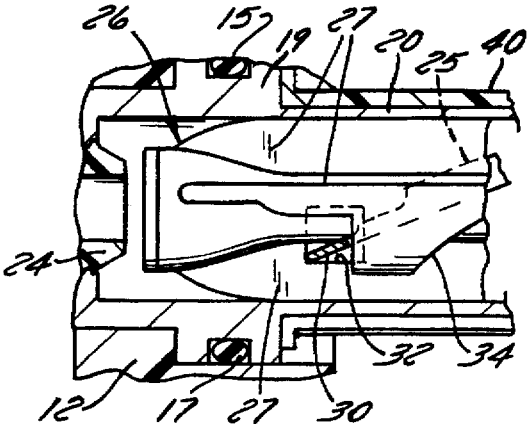
FIG. 6 is a view similar to FIG. 5 showing lever for the pressure valve in the open position.
Figure 9:
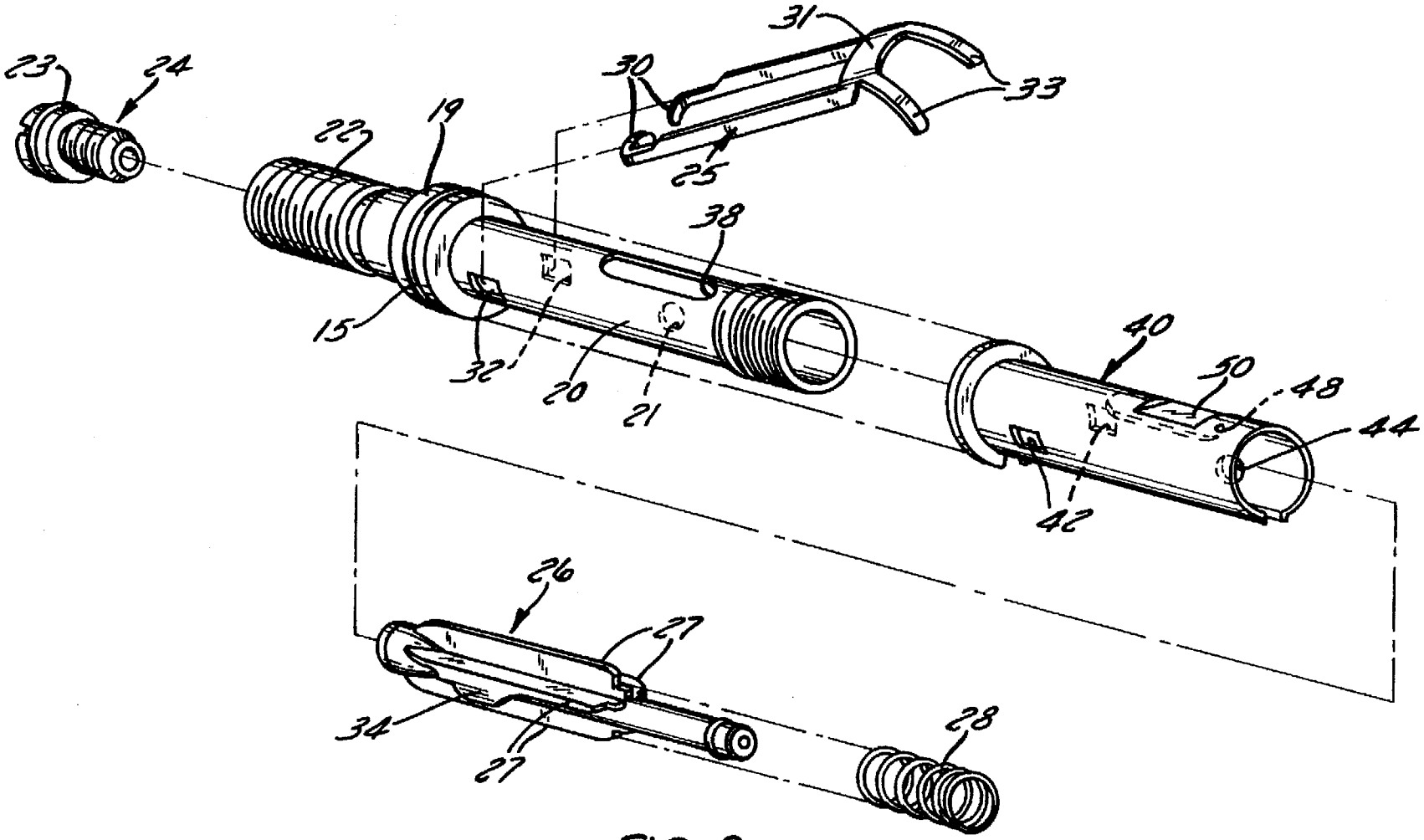
FIG. 9 is an exploded perspective view of the valve actuator assembly with the insulating sleeve aligned with the brass tube.

A diaphragm 36 is mounted in the top member 29 of the housing which operatively engages the top of the lever 25. The operator inhales gas through the mouthpiece 14 which collapses the diaphragm 36 into engagement with the lever 25. The lever 25 pivots into engagement with the brass tube 20 to move the valve poppet 26 away from the valve orifice 24 as shown in FIG. 6. An oval opening 38 is provided in the brass tube 20.

In accordance with the present invention an insulating sleeve 40, formed from a plastic material such as Delrin 500, is mounted on the brass tube 20 with openings 42 in the sleeve 40 aligned with the openings 32 in the brass tube 20. The inwardly projecting tabs 30 on the lever 25 are thereby aligned with the openings 42 in the insulating sleeve 40 and the openings 32 in the brass tube 20. The tabs 30 are aligned with the vanes 34 provided on the valve poppet 26. A gas outlet 44 is provided in the sleeve 40 and aligned with the gas outlet 21 in the brass tube 20.

The insulating sleeve 40 is provided with an oval plug 48 which matingly engages the oval opening 38 to prevent any movement between the plastic tube with respect to the brass tube. A recess 50 is provided in the surface of the sleeve to accommodate the cross member 31 on the lever 25 between the tongs 33 which allows for additional travel of the lever for increased valve opening.

In operation the diaphragm 36 collapses onto the lever 25 when the operator inhales forcing the lever 25 to pivot downward into engagement with the vane 34. The tabs 30 pivot in openings 32 and 42 to push the vane 34 on valve poppet 26 to open the valve orifice 24 to admit high pressure gas into the housing. As the pressure increases in the housing, the diaphragm 36 moves away from the tube 20, allowing the lever 25 to also pivot. The spring 28 moves the valve poppet 26 into engagement with valve orifice 24, stopping the flow of high pressure gas, as the scuba diver exhales. The exhausted gas exits through the gas outlet 16.

Thus, it should be apparent that there has been provided in accordance with the present invention a scuba diving breathing regulator that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A breathing regulator for scuba diving, said regulator comprising:

a housing having a high pressure gas inlet and discharge outlet;

a pressure regulator valve assembly operatively connected to said inlet, said assembly including a brass tube operatively connected to said gas inlet, a valve poppet mounted in said tube to control the flow of high pressure gas through said tube, a spring mounted in said tube to bias the valve poppet to a closed position, a lever connected to open the valve poppet, a diaphragm operatively positioned to engage the lever to open the valve poppet on a drop in pressure in the housing and means for insulating the brass tube to prevent icing of the tube.

2. The regulator according to claim 1 wherein said insulating means comprises a plastic tube enclosing said brass tube to prevent icing of the tube.

3. The regulator according to claim 2 wherein said brass tube includes an elliptical opening in the tube and said plastic tube including an elliptical plug corresponding to the elliptical opening in the tube to center the plastic tube in the opening.

4. The regulator according to claim 3 wherein said sleeve includes an opening the length of the tube to provide a pressure fit on the tube.

5. A breathing regulator for scuba diving, the regulator being of the type having a high pressure gas inlet within a chamber formed within a housing, a mouthpiece extending from said housing in fluid communication with said chamber for inhalation of inlet gas and exhalation of exhaust gas, and an exhaust valve located in one wall of said housing for directing exhaust gas out of said chamber, the apparatus comprising:

a metallic tube mounted in said housing, a valve poppet mounted in said metallic tube for controlling the admission of high pressure gas into the chamber, an exhaust valve in the housing for discharging gas from the chamber, the improvement comprising:

a plastic tube mounted on said metallic tube to prevent icing of the metallic tube in cold water.

* * * * *